US009025804B2

(12) United States Patent
Davis et al.

(10) Patent No.: US 9,025,804 B2
(45) Date of Patent: May 5, 2015

(54) AUDIO PERFORMANCE SYSTEM

(75) Inventors: Adam Davis, Leola, PA (US); Tyler Kicera, Manheim, PA (US); Brock Mearig, Ephrata, PA (US)

(73) Assignee: Tait Towers Manufacturing, LLC, Lititz, PA (US)

( * ) Notice: Subject to any disclaimer, the term of this patent is extended or adjusted under 35 U.S.C. 154(b) by 679 days.

(21) Appl. No.: 13/441,280

(22) Filed: Apr. 6, 2012

(65) Prior Publication Data

US 2013/0266169 A1 Oct. 10, 2013

(51) Int. Cl.

| | |
|---|---|
| ***H04R 1/02*** | (2006.01) |
| ***H04R 27/00*** | (2006.01) |
| *A47B 81/06* | (2006.01) |
| *H04R 1/40* | (2006.01) |

(52) U.S. Cl.

CPC ..... *H04R 27/00* (2013.01); *H04R 1/403* (2013.01)

(58) Field of Classification Search

CPC ..... A47B 45/00; A47B 96/025; A47F 5/10; A47F 5/12; A47F 5/13; A47G 5/0892; A47G 25/18; A47G 25/54; A47G 25/1442; F16M 11/04; F16M 11/08; F16M 11/2014; F16M 11/2092; F16M 13/02; H04R 1/02; H04R 1/021; H04R 1/025; H04R 1/026; H04R 1/047; H04R 1/20; H04R 1/26; H04R 1/227; H04R 1/323; H04R 1/403; H04R 5/02

USPC ..... 381/87, 335, 386; 414/800; 211/118, 211/175, 182; 248/282.1, 323, 324, 327, 248/164, 297.31, 299.1, 220.21; 403/59, 403/84, 157, 378, 379; 181/90, 198, 199

See application file for complete search history.

(56) References Cited

U.S. PATENT DOCUMENTS

| | | | | |
|---|---|---|---|---|
| 7,261,180 | B1 * | 8/2007 | Faranda et al. | 181/199 |
| 7,328,769 | B1 * | 2/2008 | Adamson | 181/199 |
| 2014/0307907 | A1 * | 10/2014 | Takeuchi et al. | 381/334 |

* cited by examiner

*Primary Examiner* — Brian Ensey

(57) ABSTRACT

An audio performance system for use during an event including a shipping container containing at least a first electroacoustic device. A lifting device forms a first portion of the shipping container, the lifting device configured to movably secure the first electroacoustic device between a first position for transport of the container and a second position for the event. A second portion of the shipping container is configured to be manually removable. A third portion of the shipping container is configured to positionably secure a second electroacoustic device for the event.

20 Claims, 6 Drawing Sheets

AUDIO PERFORMANCE SYSTEM

FIELD

The disclosure is generally related to an audio performance system typically associated with a public performance. More particularly, the disclosure includes a portable audio performance system.

BACKGROUND

When presenting events such as concerts or theatre productions, winches, pulleys and other equipment are commonly used for support, movement and manipulation of performers and various equipment, such as, lighting, sound, scenery and props. Such equipment, including sound equipment associated with concerts are often transported to each performance venue, requiring specialized, manual set-up or installation, as well as manual disassembly. There currently remains a need in the performance industry to provide a portable sound system that significantly reduces manual set-up, yet provides versatility to accommodate sound requirements of different venues.

What is needed is a method and apparatus that addresses the above-referenced issues and concerns. The present device addresses the issues listed above.

SUMMARY

In an exemplary embodiment, an audio performance system for use during an event including a shipping container containing at least a first electroacoustic device. A lifting device forms a first portion of the shipping container, the lifting device configured to movably secure the first electroacoustic device between a first position for transport of the container and a second position for the event. A second portion of the shipping container is configured to be manually removable. A third portion of the shipping container is configured to positionably secure a second electroacoustic device for the event.

In a further exemplary embodiment, a method for supplying audible signals to an audience for a corresponding performance includes providing a shipping container including a first electroacoustic device configured to generate audible signals and corresponding components to permit operation of the first electroacoustic device. The first electroacoustic device is secured to a lifting device in a first position during transport of the container, the lifting device forming a first portion of the shipping container. The method further includes moving the first electroacoustic device from the first position to a second position for the performance with the lifting device. The method further includes manually removing a second portion of the shipping container.

Another aspect includes providing an audio performance system using a shipping container that can be manually converted for use during an event in which a first electroacoustic device is moved from a first position to a second position by a lifting device that forms a first portion of the shipping container, the shipping device capable of airborne movement.

It is to be understood that an embodiment of an audio performance system may include one or more of the above-described aspects.

Further aspects of the method and system are disclosed herein. The features as discussed above, as well as other features and advantages of the present disclosure will be appreciated and understood by those skilled in the art from the following detailed description and drawings.

DETAILED DESCRIPTION

Provided is an audio performance system that can be easily and rapidly converted from a transport configuration of a shipping container containing an electroacoustic device to a configuration in which the shipping container may be used as part of a performance or event, typically, but not necessarily attended by the public. Such a performance or event may occur as part of a performance of a professional entertainer, speaker, sporting event or other occasion. However, for purposes of the disclosure, any purpose or event associated with an audio transmission is contemplated, and the term performance or event may be used interchangeably.

Figure 1:
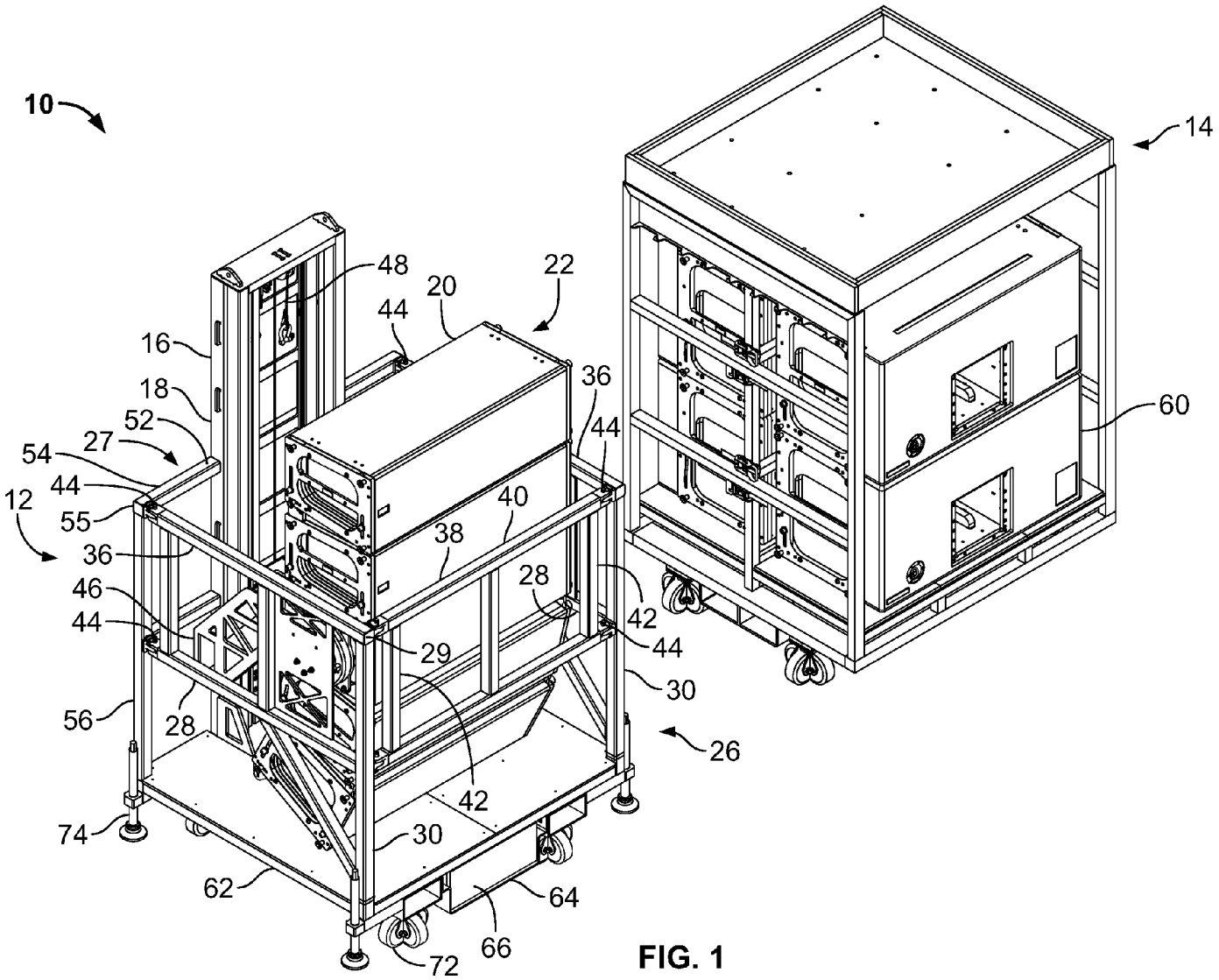
FIG. 1 shows a perspective view of a shipping container configured for transport according to an exemplary embodiment of the disclosure.
Figure 2:
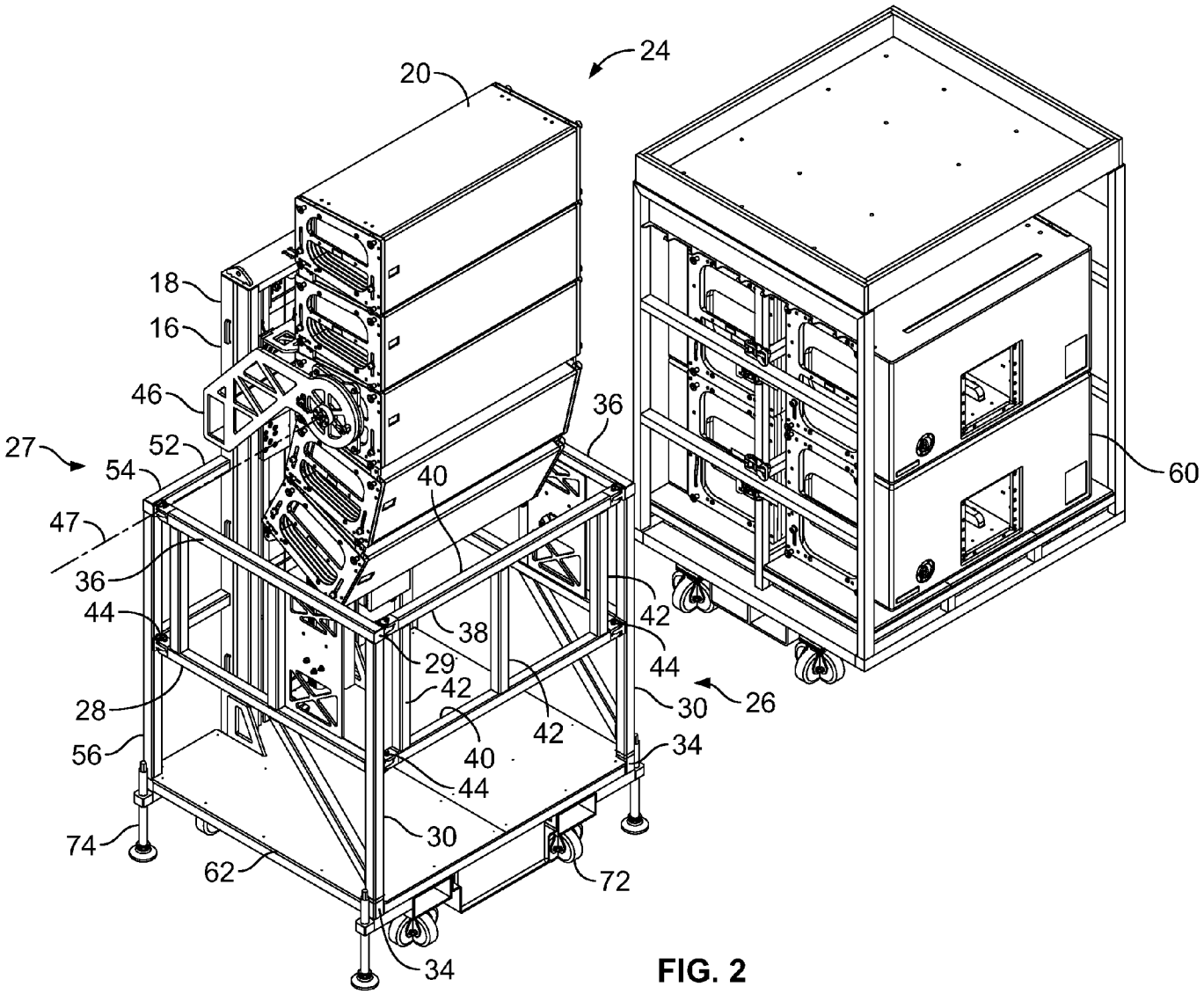
FIG. 2 shows a perspective view of a shipping container configured for an event according to an exemplary embodiment of the disclosure.

FIG. 1 shows a perspective view of an audio performance system 10 including a shipping container 12 and a shipping container 14. In one embodiment, shipping containers 12, 14 are sized to be portable by commercial air, land or sea transportation apparatus. Shipping container 12 includes a first electroacoustic device 20, such as an audio speaker that is secured in a first position 22 to a lifting device 16. As shown in the figures, first electroacoustic device 20 shows a plurality, also referred to as an array of devices that may be arranged to deliver optimum audio performance for an event. In another embodiment, lifting device 16 may be secured to a single first electroacoustic device 20. For purposes of the disclosure, the term electroacoustic device may refer to one or more electroacoustic device(s). First position 22 of lifting device 16 is associated with the contents of the shipping container being secured for transport, i.e., the shipping container is in a transport mode. As further shown in FIG. 1, shipping container 14 is also in a transport mode, and contains a plurality of third electroacoustic devices 60, such as sub woofer audio speakers for use with an event. Shipping container 12 is converted to a performance mode by virtue of movement of first electroacoustic device 20 by lifting device 16 from first position 22 to second position 24 (FIG. 2). In other words, in performance mode, first electroacoustic device 20 is positioned to deliver optimum audio performance to an audience of an event.

As further shown in FIG. 1, lifting device 16 of shipping container 12 forms a first portion 18 of the shipping container. That is, lifting device 16 is a structural component forming a portion of shipping container 12. As further shown in FIG. 1, first portion 18 of lifting device 16 extends to opposed third portions 27 that each define an interconnected corner frame 52 including a horizontal corner frame member 54 and a vertical corner frame member 56. Securing ends of horizontal corner frame member 54 and vertical corner frame member 56 together, such as by welding, form a corner 55 of corner frame 52. One third portion 27 of the pair of third portions 27 is shown more clearly in FIGS. 3 and 4.

As shown in FIG. 1, shipping container 12 includes a second portion 26 that collectively defines a pair of opposed interconnected corner frames 28 separated by an interconnected frame 38. As further shown in FIG. 1, second portion 26 collectively extends along three of the four sides of a base 62 of shipping container 12. As more clearly shown in FIG. 3, which is an exploded perspective view of each of the opposed interconnected corner frames 28 and interconnected frame 38 with respect to base 62, each interconnected corner frame 28 includes a horizontal corner frame member 36 and a vertical corner frame member 30 that are secured together at their respective ends, such as by welding to form a corner 29. The end of each vertical corner frame member 30 opposite corner 29 defines a tapered end 32 (disassembled vertical corner frame members shown in FIG. 3) that is received in a socket 34 of base 62 of shipping container 12 (assembled vertical corner frame members 30 shown in FIG. 1).

Figure 3:
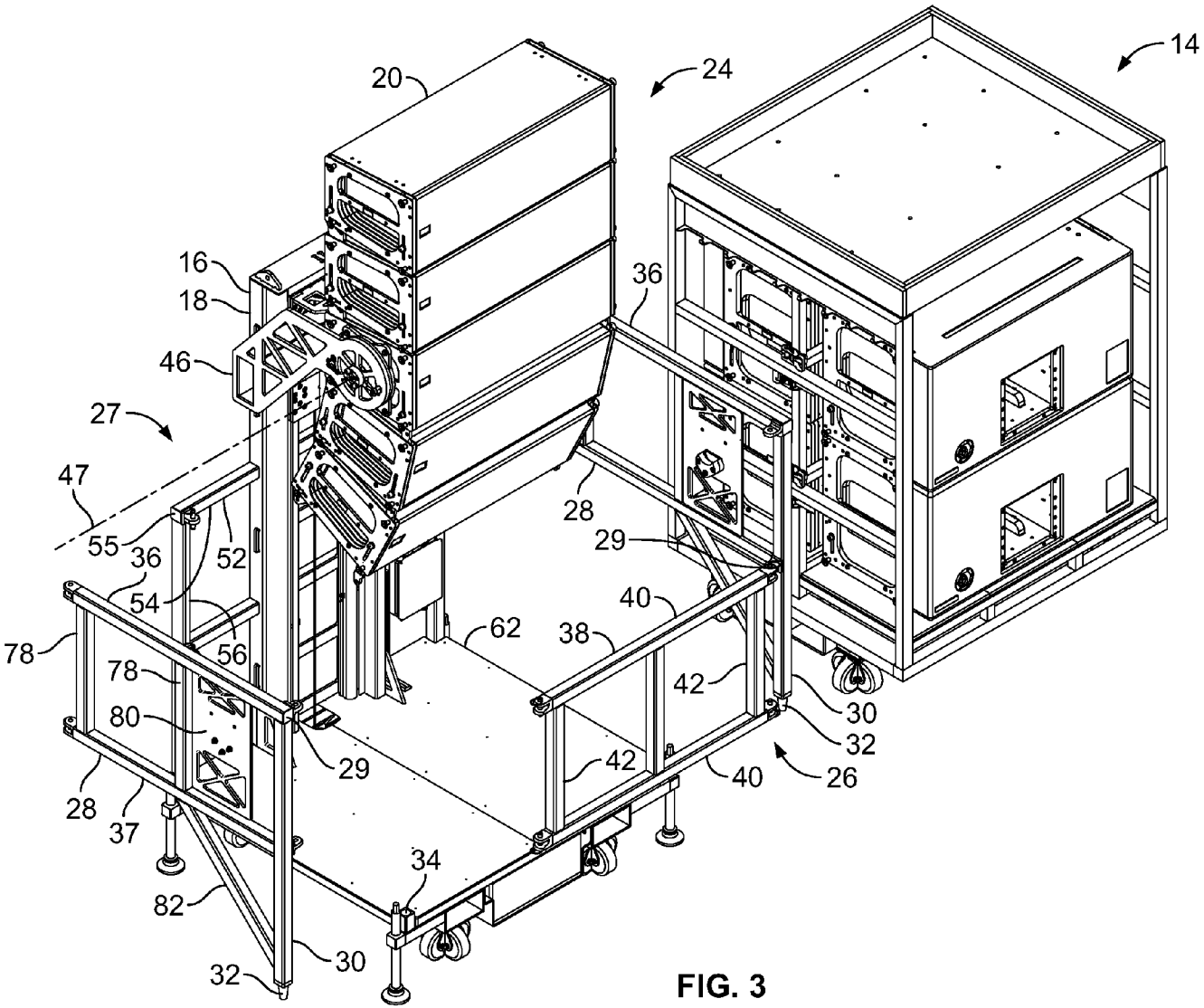
FIG. 3 shows an exploded view of the shipping container of FIG. 2 according to an exemplary embodiment of the disclosure.

As further shown in FIG. 3, corner frame 28 further includes a horizontal frame member 37 separated by and collectively secured to a pair of vertical frame members 78 and a stiffener 80, such as by welding. An angled frame member 82 is secured between vertical corner frame member 30 and horizontal frame member 37, such as by welding, providing additional structural rigidity and support to interconnected corner frame 28. As further shown in FIG. 3, interconnected frame 38 includes horizontal frame members 40 and vertical frame members 42 joined together, such as by welding. When the ends of opposed interconnected corner frames 28 and interconnected frame 38 are brought together along the periphery of base 62 with interconnected corner frame 52, the abutting ends of the frames collectively form a closed box structure that when secured together by a fastener, each define a fastened joint 44. In one embodiment, the fasteners are configured for manual disassembly, and in yet another embodiment are quick release fasteners, such as ball-lock fasteners. That is, an individual should easily be able to form fastened joints 44 without requiring a tool, i.e., not requiring additional leverage normally required by wrenches, levers, etc. In summary, upon disassembly of fastened joints 44, each of the opposed interconnected corner frames 28 and interconnected frame 38 may be quickly and easily manually removed from shipping container 12.

It is to be understood that the removal of the frames composing second portion 26 provide unobstructed visual access to three of the four sides of shipping container 12, using base 62 for purposes of positional orientation. In this arrangement, lifting device 16 would typically be positioned opposite an intended audience of an event in order to provide visual access and maximize audio performance of the electroacoustic devices.

As further shown in FIG. 2, once leveling legs 74 are set (removing weight from casters 72) lifting device 16 is actuated from a first position 22 (FIG. 1) typically associated with a transport mode of the shipping device, to a raised second position 24 that is associated with a performance mode as previously discussed. As shown in the figures, lifting device 16 includes a yoke 46 that is constrained to move vertically along first portion 18. That is, yoke 46 cannot rotate with respect to first portion 18. Yoke 46 is urged to move along first portion 18 between the first and second positions 22, 24 by a cable 48 (FIG. 1) powered by a motor (not shown). In another embodiment, cable 48 may be manually actuated. As further shown in FIG. 3, yoke 46 is moveably secured to first electroacoustic device 20 such that first electroacoustic device 20 is selectably rotatable about axis 47. In one embodiment, axis 47 is positioned in close proximity with the center of gravity of first electroacoustic device 20 for purposes of stability, although first electroacoustic device 20 may be rotated as required to provide optimum audio performance for an event. Adjustment of first electroacoustic device 20 includes an option of angular adjustment in predetermined increments, such as insertion of a pin or other device in one of a plurality of angularly spaced openings formed in yoke 46 surrounding axis 47, and/or an arcuate slot formed concentrically In yoke 46 with respect to axis 47 that permits a device, such as a threaded pin with a handle (not shown) to be secured to first electroacoustic device 20, permitting custom angular adjustment. In addition, the angular spacing between individual first electroacoustic devices 20 also include an amount of adjustment therebetween.

Figure 4:
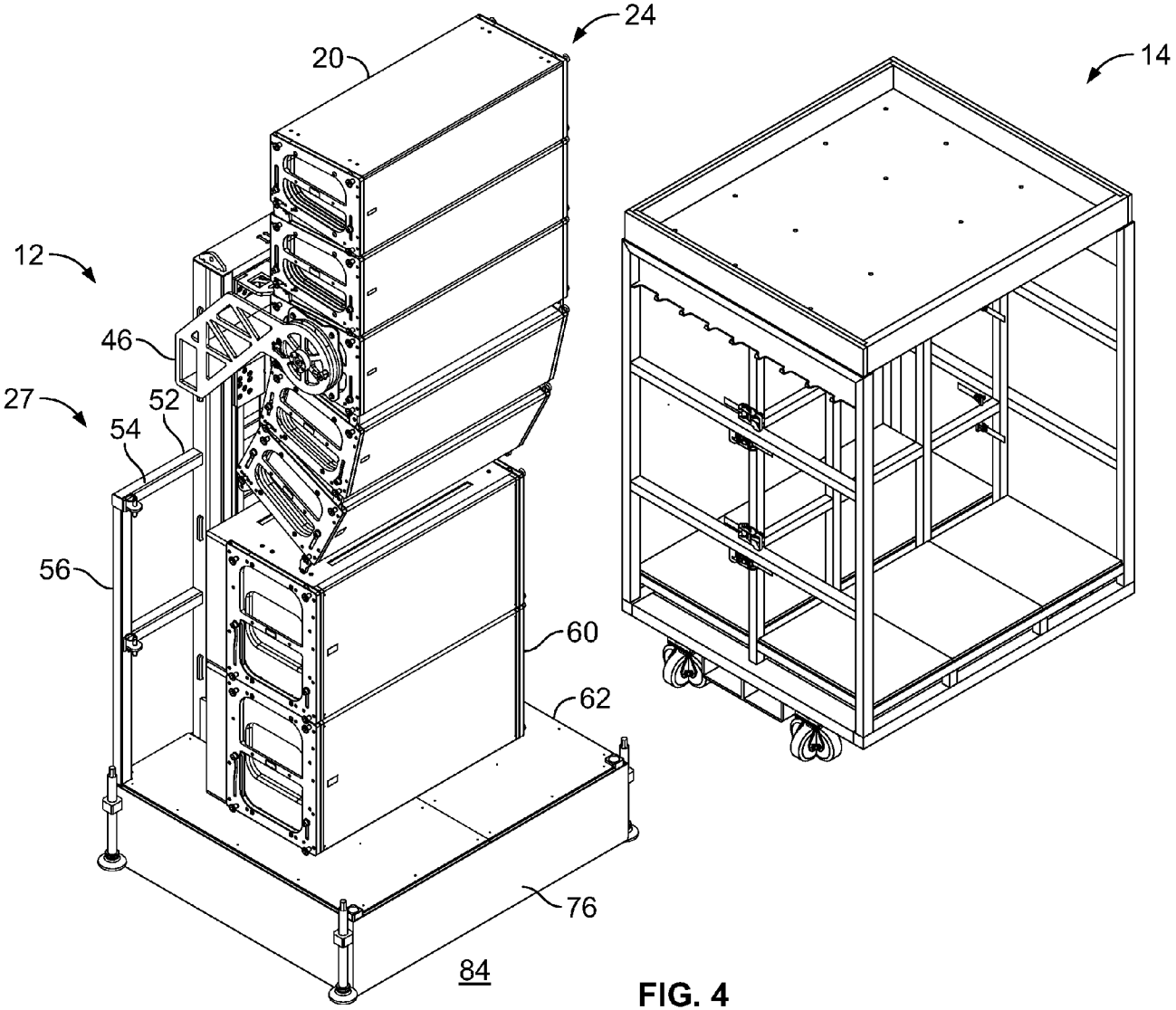
FIG. 4 shows a perspective view of the shipping container of FIG. 3, with the "exploded" structural components removed, according to an exemplary embodiment of the disclosure.

As shown in FIG. 4, shipping container 12 is arranged with first electroacoustic device 20 positioned in second position 24 (performance mode) with second portion 26 (FIG. 3) removed. FIG. 4 further shows the inclusion of a pair of third electroacoustic devices 60 supported on base 62 beneath first electroacoustic devices 20. In another embodiment, third electroacoustic devices 60 may be suspended from first electroacoustic devices 20. The pair of third electroacoustic devices 60 were previously secured in shipping container 14 (FIG. 2) in transport mode. As further shown in FIG. 4, a cover 76 extends between a supporting surface 84, such as the ground and base 62 to provide an aesthetically pleasing arrangement, as well as concealing casters 72 and a compartment 64 configured to secure a fourth electroacoustic device 66 (FIG. 1). In other words, cover 76 substantially prevents viewing of components contained beneath base 62, most notably fourth electroacoustic device 66.

Figure 5:
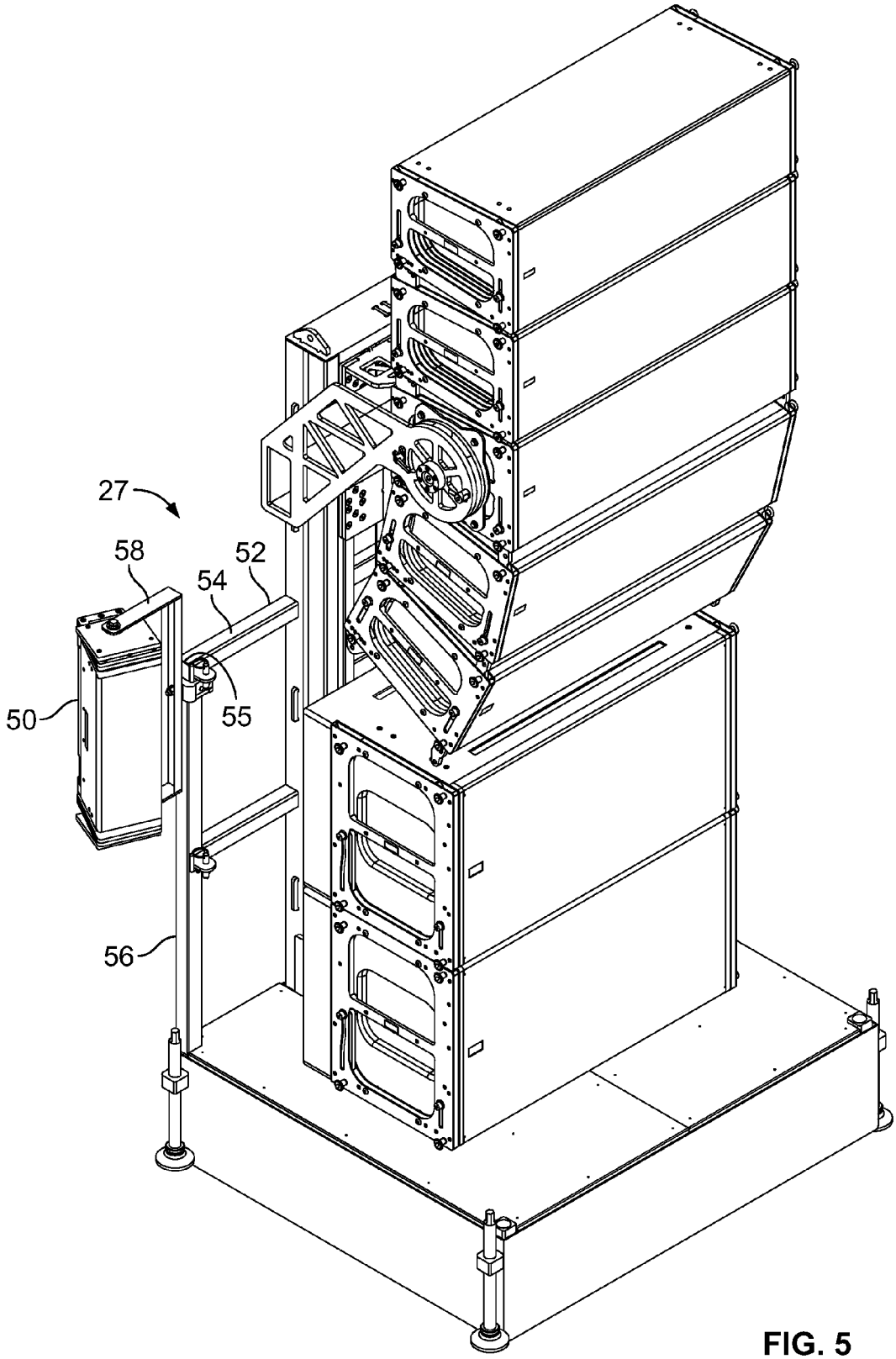
FIG. 5 shows a perspective view of the shipping container of FIG. 3, with the "exploded" structural components removed, according to an exemplary embodiment of the disclosure.

As shown in FIG. 5, the shipping container arranged in performance mode as shown in FIG. 4 can further include a pair of second electroacoustic devices 50 secured by a yoke 58 that is rotatably secured in close proximity to corner 55 of third portion 27. Only one second electroacoustic device 50 is shown in FIG. 5.

Figure 6:
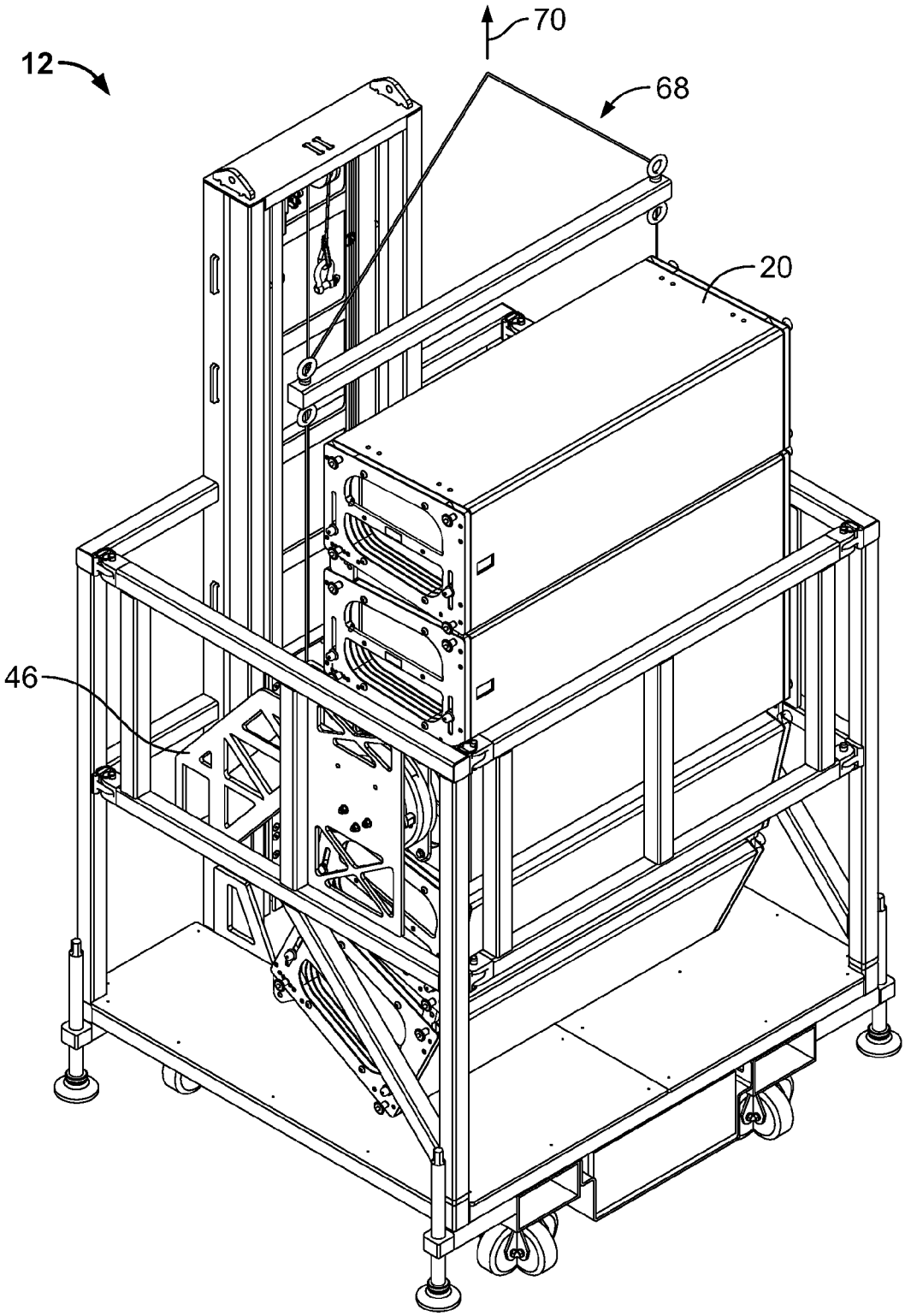
FIG. 6 shows a perspective view of the shipping container configured for airborne movement of the shipping container according to an exemplary embodiment of the disclosure.

As shown in FIG. 6, shipping container 12 while in transport mode can be configured for airborne movement as required. An air lifting assembly 68 can be secured to yoke 46 or other appropriate structurally robust portion of the shipping container prior to application of a vertical lifting force 70 that is applied to move the shipping container 12. In another embodiment, shipping container 14 while in transport mode can also be configured for airborne movement as required.

It is important to note that the construction and arrangement of the present application as shown in the various exemplary embodiments is illustrative only. Only certain features and embodiments of the invention have been shown and described in the application and many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An audio performance system for use during an event comprising:

a shipping container containing at least a first electroacoustic device;

a lifting device forming a first portion of the shipping container, the lifting device configured to movably secure the first electroacoustic device between a first position for transport of the container and a second position for the event;

a second portion of the shipping container configured to be manually removable;

a third portion of the shipping container configured to positionably secure a second electroacoustic device for the event.

2. The system of claim 1, wherein the lifting device has a yoke for movably securing the first electroacoustic device.

3. The system of claim 1, wherein the yoke has an axis, the yoke configured to permit a controllable rotational movement of the first electroacoustic device about the axis with respect to the lifting device.

4. The system of claim 1, wherein a third electroacoustic device may be suspended from the first electroacoustic device when the lifting device is in the second position.

5. The system of claim 1, wherein the shipping container includes a base for supporting a third electroacoustic device beneath the first electroacoustic device when the lifting device is in the second position.

6. The system of claim 5, wherein the base includes a compartment for securing a fourth electroacoustic device therein.

7. The system of claim 6, including a cover extending between a supporting surface and the base to substantially prevent viewing of the fourth electroacoustic device.

8. The system of claim 1, including an airlifting assembly for airborne movement of the shipping container.

9. The system of claim 1, wherein when the shipping container is configured to be transported, the second portion and the third portion are assembled together to form fastened joints.

10. The system of claim 9, wherein the fastened joints between the second portion and the third portion are secured by fasteners configured for manual disassembly.

11. The system of claim 1, wherein the fasteners are quick release fasteners.

12. The system of claim 1, wherein the shipping container is sized to be portable by commercial air, land or sea transportation apparatus.

13. A method for supplying audible signals to an audience for a corresponding performance comprising:

providing a shipping container including a first electroacoustic device configured to generate audible signals and corresponding components to permit operation of the first electroacoustic device, the first electroacoustic device secured to a lifting device in a first position during transport of the container, the lifting device forming a first portion of the shipping container; and moving the first electroacoustic device from the first position to a second position for the performance with the lifting device; and manually removing a second portion of the shipping container.

14. The method of claim 13, including securing a second electroacoustic device to a third portion of the shipping container.

15. The method of claim 13, wherein the lifting device has a yoke for movably securing the first electroacoustic device.

16. The method of claim 13, wherein the yoke has an axis, the yoke configured to permit a controllable rotational movement of the first electroacoustic device about the axis with respect to the lifting device.

17. The method of claim 13, wherein the shipping container includes a base for supporting a third electroacoustic device beneath the first electroacoustic device when the lifting device is in the second position.

18. The system of claim 17, wherein the base includes a compartment force securing a fourth electroacoustic device therein.

19. The method of claim 18, including an airlifting assembly for airborne movement of the shipping container.

20. The method of claim 13, wherein the shipping container is sized to be portable by commercial air, land or sea transportation apparatus.

* * * * *